US007578175B2

(12) United States Patent
Ban

(10) Patent No.: US 7,578,175 B2
(45) Date of Patent: Aug. 25, 2009

(54) METHOD OF DESIGNING AN IRON SOLE SHAPE, AND SYSTEM FOR THE SAME

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 119 days.

(21) Appl. No.: 11/642,603

(22) Filed: Dec. 21, 2006

(65) Prior Publication Data

US 2007/0144241 A1 Jun. 28, 2007

(30) Foreign Application Priority Data

Dec. 26, 2005 (JP) ..... 2005-372959

(51) Int. Cl.
*A63B 53/00* (2006.01)

(52) U.S. Cl. ..... 73/65.03; 473/349

(58) Field of Classification Search ..... 73/65.03; 473/282, 290, 409

See application file for complete search history.

(56) References Cited

U.S. PATENT DOCUMENTS 5,768,151 A * 6/1998 Lowy et al. ..... 463/2
6,083,123 A * 7/2000 Wood ..... 473/409
6,561,917 B2 * 5/2003 Manwaring ..... 473/151
6,602,147 B2 * 8/2003 Shiraishi ..... 473/291
6,793,585 B1 * 9/2004 Miyamoto et al. ..... 473/151
7,010,965 B2 * 3/2006 Cameron ..... 73/65.03
7,281,417 B2 * 10/2007 Saegusa et al. ..... 73/65.03
7,395,696 B2 * 7/2008 Bissonnette et al. ..... 73/65.03

FOREIGN PATENT DOCUMENTS

JP 2005-006763 A 1/2005

* cited by examiner

*Primary Examiner*—Lisa M Caputo
*Assistant Examiner*—Freddie Kirkland, III
(74) *Attorney, Agent, or Firm*—Sughrue Mion, PLLC

(57) ABSTRACT

The sole shape can be designed with ease. The invention provides a method for designing an iron sole shape that includes the steps of setting different parameter values (S1) relating to a sole shape while keeping parameters other than those of the sole shape constant, preparing an iron club (S2) having the parameter values that have been set, a tester using the iron club that has been prepared to hit a ball (S4), measuring a path of the club head (S5) using a camera to obtain data relating to a position and a velocity of the club head, and determining whether or not the sole shape is favorable (S6) based on the data that have been obtained.

10 Claims, 4 Drawing Sheets

METHOD OF DESIGNING AN IRON SOLE SHAPE, AND SYSTEM FOR THE SAME

BACKGROUND OF THE INVENTION

1. Field of the Invention

The present invention relates to methods for designing the sole shape of golf club irons, and systems for the same.

2. Description of Related Art

There are many parameters to the shape of a golf club head. Club heads generally include a face portion, a top line portion (in iron heads; wood heads have a crown portion), a side portion, a sole portion, and a toe portion, and are joined to a shaft. A golf club's performance changes based not only on the size of those portions, but also on the lie angle between the shaft and the ground when looking at the club head from the face side, the loft angle between the shaft axis and the face surface when looking at the club head from the toe side, the face angle of the face surface with respect to the shaft axis when looking at the club head from above, and the relationship between the largest deflection position of the face surface and the position of the center of gravity of the head unit itself that is projected onto the face surface. The material of the club head and the shaft design also have an impact on club performance.

In the case of an iron, its sole portion forcefully strikes the ground. The shape of the sole is also a crucial element in minimizing head shake without reducing head speed. As shown in FIG. 6, the shape of the sole may be bounce, scoop, round, or flat, and each of these shapes is designed to fit the function that is expected of that club, such as making balls easier to hit up, improving the swing-though release, and increasing head stability during impact. The sole portion also may be provided with a groove or some other types of patterns. When the shaft axis is positioned vertical to the ground, viewed from the toe side, the sole surface opens up toward the front of the club in the bounce sole and toward the rear in the scoop sole. The overall shape of the bounce sole or the scoop sole is defined by the bounce angle (a) or the scoop angle (b) between the ground and the sole surface respectively. Round soles have a curved sole surface and cannot be defined by the bounce or scoop angle. Flat soles are designed so that their sole surface is parallel to the ground, and have bounce and scoop angles of 0°. Other important parameters include the weight distribution within the iron head, the width of the sole surface, and, in the case of round soles, the radius of curvature of the sole surface.

There are thus many types of sole shapes, and in designing those shapes there is a need to more quantitatively evaluate the effects of the sole shape. Further, each person has their own unique golf swing. Although a sole design that matches the characteristics of a player's golf swing is preferable, the choice of solve designs is currently made based on instinct. If it is possible to systematically arrive at the shape or parameter values of an ideal sole, then sets of irons that include different sole shapes may be provided for different players.

It should be noted that the method presented in JP 2005-6763A is known as one method for creating prototype golf club heads and then evaluating those heads.

SUMMARY OF THE INVENTION

It is an object of the invention to provide a systematic method for determining a sole shape, and a system for implementing that method.

The invention provides a method of designing an iron sole shape that includes a step of setting different parameter values relating to a sole shape while keeping parameters other than those of the sole shape constant, a step of preparing an iron club having the parameter values that have been set, a step of a tester using the iron club that has been prepared to hit a ball, a step of measuring a path of the club head using a camera, a step of obtaining data on a position and a velocity of the club head based on the results of the measurement step, and a step of determining whether or not the parameter values that have been set are favorable based on the data that have been obtained.

This method of the invention can be further provided with a step of a computation means statically processing the data to determine whether the parameter values that have been set are favorable. It is also preferable that the method is further provided with a step of assessing the "release" of the individual sole shapes. It is preferable that the evaluation of "release" is done by obtaining feedback from testers after each shot, and considering at least the velocity of the club head.

The method of the invention preferably also includes a step of measuring an initial velocity and a direction of the ball hit by the tester, and a step of determining whether or not the parameter values relating to the sole shape are favorable based on variations in the measured initial velocity or the direction, or both.

It should be noted that the invention incorporates iron clubs and iron club sets designed according to the method of the invention set forth above, Iron clubs normally are sold in a set of six to ten clubs. Normally, iron clubs include clubs from number 3 to number 9 for hitting the ball for different distances, and a pitching wedge (PW), an approach wedge (AW), and a sand wedge (SW), which are called "wedges."

The invention also provides an iron sole design system that includes a high-speed camera for capturing images of a tester hitting a ball with an iron club in order to capture a path traveled by an iron head, a head computation means for image processing the path that has been captured, so as to obtain data on the position and velocity of the iron head through image processing, a display means for displaying the date on the position and velocity, and a first determination means for determining, based on a predetermined determination standard, whether or not the parameter values relating to the sole shape of the iron club are favorable based on at least the data on the velocity, and displaying the result of this determination.

The system of the invention preferably also includes a ball computation means that employs image processing to obtain data on the initial velocity and direction of the ball that has been hit, and a second determination means for determining whether or not the parameter values relating to the sole shape are favorable based on variations in the initial velocity or direction, or both, of the ball.

With this invention, preferably a black mark on white or a white mark on black is attached to the toe portion of the iron head. This mark can be captured by the camera and used to analyze the path of the iron head. It is possible to provide one or more such marks. For example, it is possible to perform image processing such as binary processing in order to identify this mark and record the path of the iron head. This image processing can be executed using a personal computer.

The camera can be a high-speed video camera, or can be another camera type, and there are no limitations regarding the camera as long as it is high-speed and allows the instantaneous position of the iron head during a swing of the club to be followed. It is preferable that the high-speed video is captured at a speed of at least 3000 fps, such as 4000 fps.

To determine whether the specific parameter values relating the sole shape are favorable, it is also possible to consider the quality of the iron head "release." A good iron head "release" means that the feel of swinging through the ball when the club hits the ball is good, and in general this can be thought to mean that the distance traveled by the ball that has been hit will tend to be constant. A head with a poor "release" will hit the ground hard when swung and may cause fluctuations in the speed of the iron head depending on how the head hits the ground. Also, the release may affect the speed of the impact on the ball or the magnitude of the force that is transmitted to the ball depending on the type of earth that the iron head has hit. A bad release may result in the ball not being carried in a constant manner and increase the likelihood of a missed shot.

In addition to feedback from the tester, standards for determining whether the "release" is good include calculating the initial velocity and direction of the ball as it is hit, in the same way that the path of the iron head is captured, and if the initial velocity and the direction are within fixed ranges, or if little variations exist, it can be determined that the "release" is good. If variations in the initial velocity and the direction are large and they are not within the fixed ranges, then it is determined that the "release" is poor.

Thus, while golf club irons have soles with diverse shapes, the present invention allows the effects of the sole shape design to be evaluated more quantitatively. Further, significant variations exist among individual players in the path traveled by the golf club as it is swung, and the present invention allows soles that fit a particular player's characteristics to be designed more systematically. That is, because it is possible to determine the shape or parameter values for an ideal sole, it becomes possible to more easily provide a set made of irons each of whose sole shape has been chosen to fit an individual player.

DETAILED DESCRIPTION OF A PREFERRED EMBODIMENT

The method and system of the invention can be implemented as in the working examples described in the following.

Figure 1:
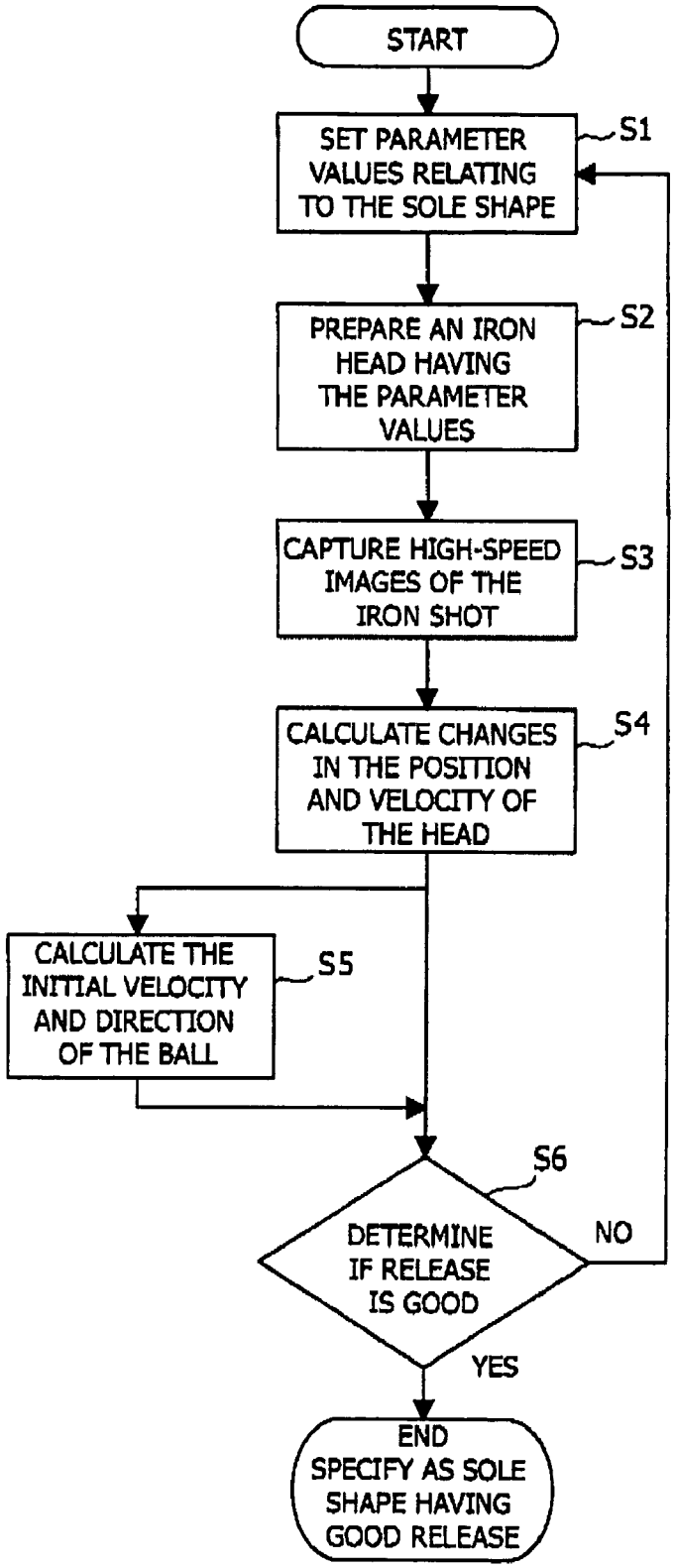
FIG. 1 is a flowchart showing an embodiment of the method of the invention.
Figure 2:
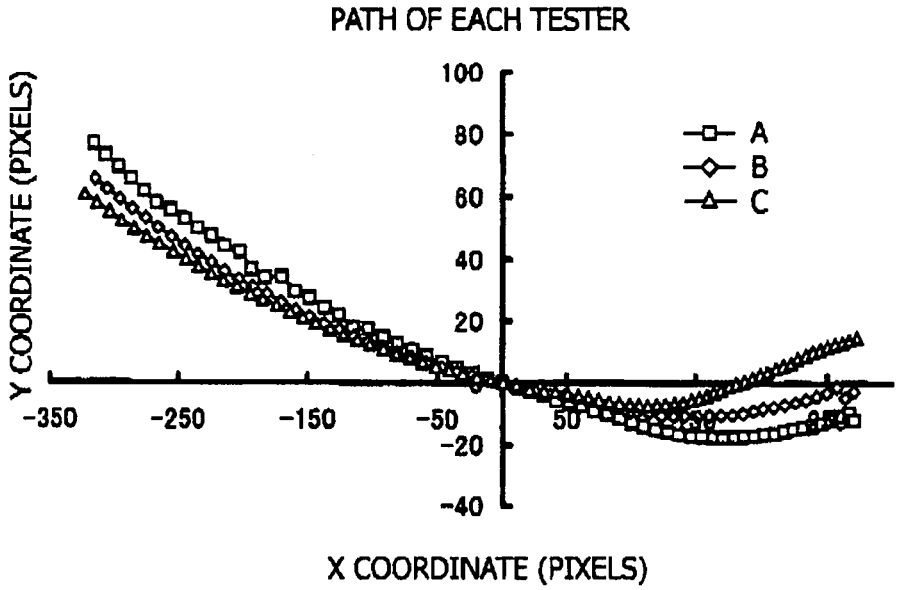
FIG. 2 is a graph showing the path of the head for the testers (testers A, B, and C) in the embodiment of the invention.
Figure 3:
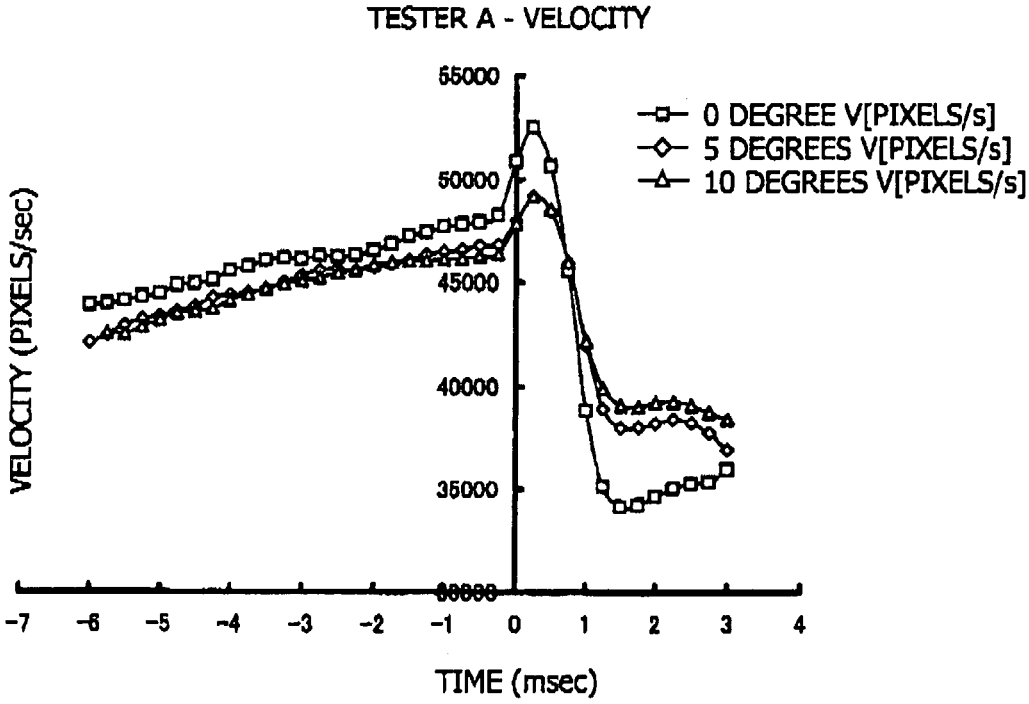
FIG. 3 is a graph showing the change in head velocity when the tester A uses three irons, each having a different bounce angle, to hit the ball.
Figure 4:
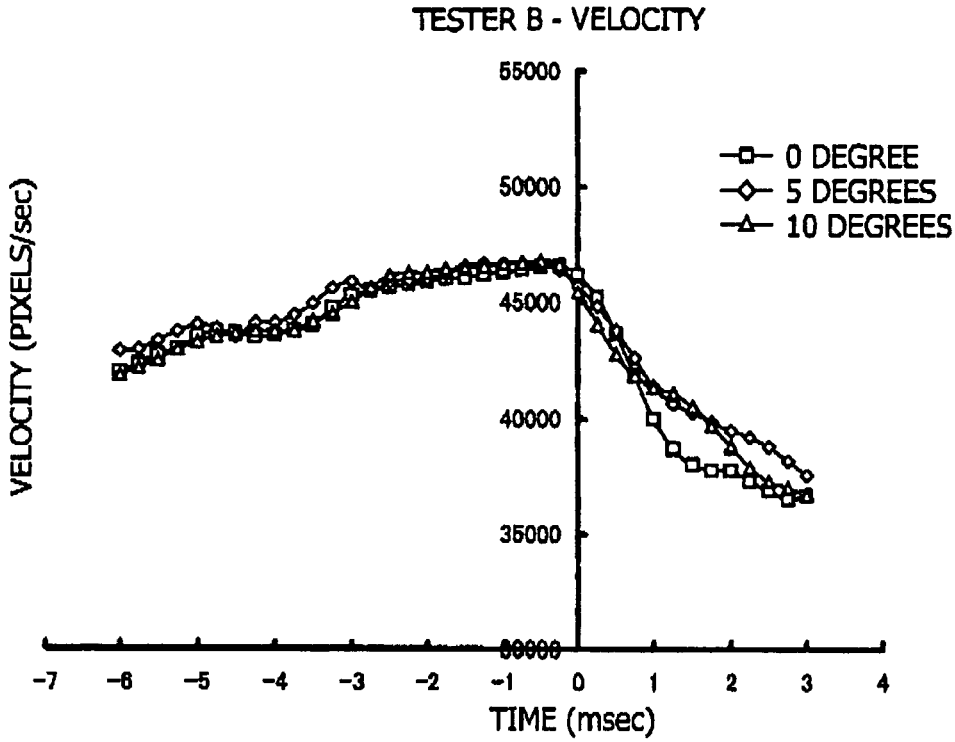
FIG. 4 is a graph that similarly shows the change in head velocity when the tester B uses three irons, each having a different bounce angle, to hit the ball.
Figure 5:
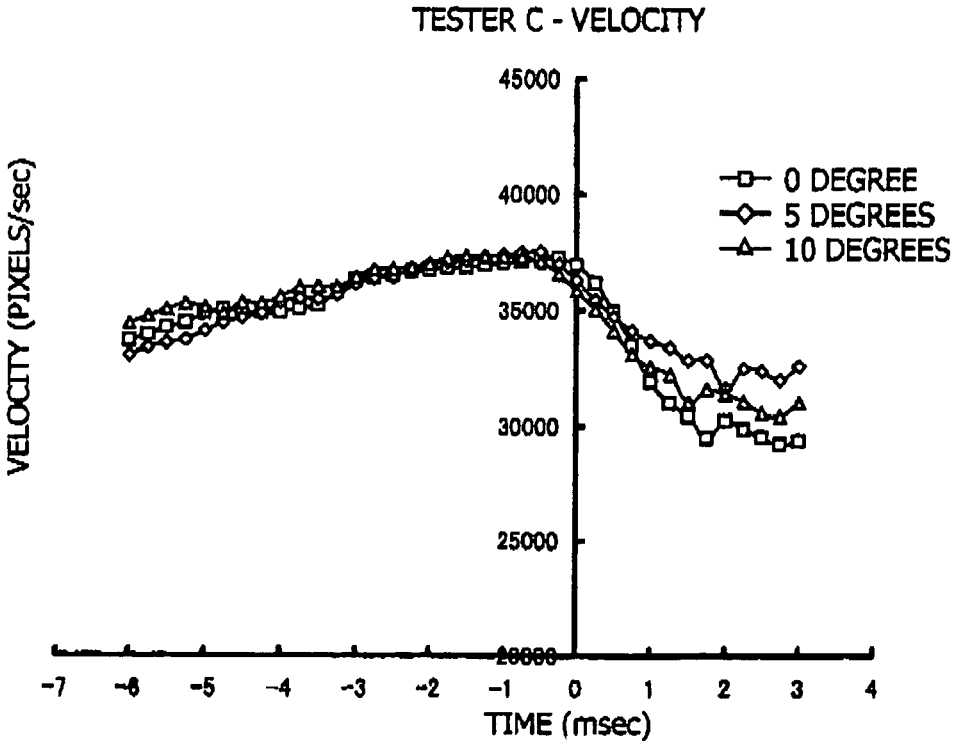
FIG. 5 is a graph that shows the change in head velocity when the tester C uses three irons, each having a different bounce angle, to hit the ball.
Figure 6:
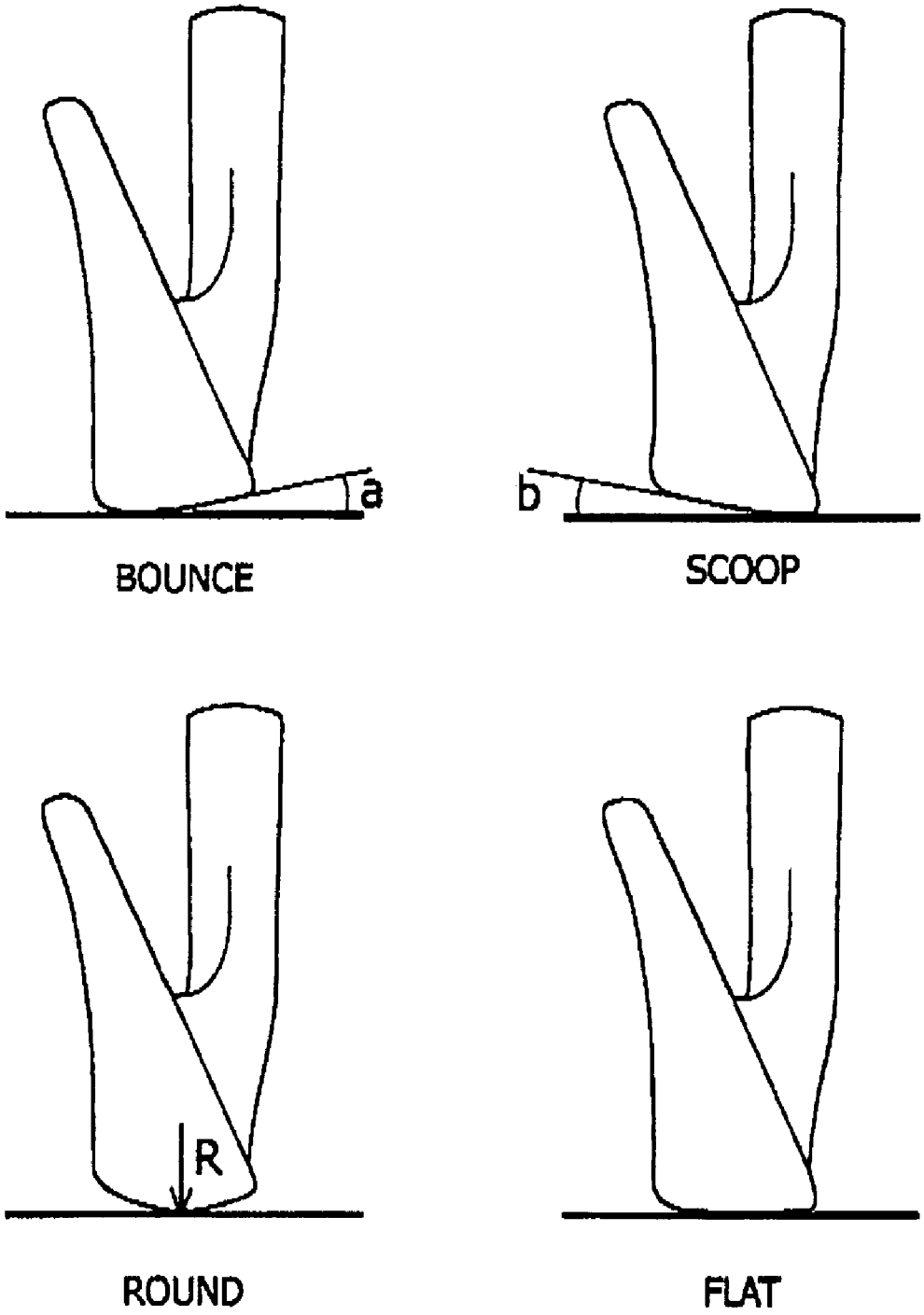
FIG. 6 is a lateral face view from the toe side of club heads showing variations in the sole shape of the iron head.

An embodiment of the invention is described with reference to FIG. 1. Broadly, categorized sole shapes include bounce, scoop, round, and flat soles. When the bounce sole has been chosen, the bounce angle becomes an important parameter for defining the shape of the sole. Trials are run choosing bounce angles of 0° (flat sole), 5°, and 10°, for example (S1). Numerous iron heads having parameter values relating to the different sole types are prepared in advance and can be used in the trials (S2). Alternatively, it is also possible to prepare clubs with special heads for practice swings, in which parameters such as the bounce angle have been changed.

Next, the player (tester) actually hits a ball using a club having such an iron head. The path traveled by the club head is captured by a high-speed video camera (S3). Attaching a marker such as a circle on black or a circle on white to the toe portion of the club head allows image analysis of the high-speed video camera output to be performed with ease. There are no particular limitations regarding the size of the marker, and for example it is possible to form a 5 mm diameter circle or a square having 5 mm sides in a 1.5 cm square area. The high-speed video camera generally is located about 70 cm to 100 cm away from the ball. The camera captures the player's swing from the side starting from a low position of the club head near the ground. The output of the high-speed video camera is input to a general personal computer, and image analysis is performed on the computer using software for analyzing moving images. The instantaneous position and velocity of the club head can be found as a result of the image analysis (S4).

In this embodiment, the FASTCAM-MAX made by Photron Ltd. was used as the high-speed video camera, and the FASTCAM-VIEWER made by Photron Ltd. was used as the image capturing software. The TEMA (Track Eye Motion Analysis) software made by Photron Ltd. was used as the moving image analysis software. As for the lens, an AF-S NIKKOR 17-35 mm 1:2.8D made by Nikon was set to an image capture focal length of 17 mm. The frames per second was set to 4000 fps, and the shutter speed was set to $1/30000$ sec. For the resolution, 1024×512 pixels was used. The distance from the tip of the lens to the ball was 70 cm.

At this time, if necessary, or if desired, it is also possible to perform image analysis of the path traveled by the ball, in addition to performing image analysis of the path traveled by the club head (S5). In such a case, one approach is to obtain date on the initial velocity and flight direction of the ball. The initial velocity and direction of the ball also can serve as standards for finding the most suitable sole shape, in addition to the path and velocity of the club head found in step S4. In general, smaller variations in the initial velocity and direction of the ball is a sign of an iron with good "release."

If it is determined from the data and player feedback that the shape of the iron sole allows for good "release" (S6), then testing is finished and the same trial can be performed for the iron of the next number, for example. If it is thought that the shape of the iron sole does not allow for good "release," then the sole shape is changed or parameters that define the sole shape are changed, and the trial is repeated.

FIG. 2 to FIG. 5 show specific trial results for three players (testers A, B, and C). As mentioned above, in this embodiment, testing was performed with soles having different bounce angles of 0°, 5°, and 10°. The results are shown in Table 1 below.

TABLE 1

| | | Test Results | | |
|---|---|---|---|---|
| | | Tester A | Tester B | Tester C |
| HS | | fast | fast | slow |
| Incidence Angle | | large | small | small |
| Velocity Drop | 0° | large | large | large |
| | 5° | small | small | small |
| | 10° | small | small | medium |

TABLE 1-continued

| | | Test Results | | |
|---|---|---|---|---|
| | | Tester A | Tester B | Tester C |
| Release Assessment | 0° | poor | poor | poor |
| | 5° | good | good | excellent |
| | 10° | good | excellent | poor |

In Table 1, "HS" is short for head speed, and indicates the speed of the iron head immediately before hitting the ball. The "incidence angle" refers to the angle of the path traveled by the iron head with respect to the ground at the time of impact. A large incidence angle indicates that the iron head is swung toward the ground from above, and a small incidence angle indicates that the iron head sweeps over the ground. The HS and the incidence angle together give a good indication of the unique characteristics of each tester, and it should be pointed out that there is significant variation among the testers regarding these. The velocity drop indicates the drop in the velocity of the club head before hitting the ball and after hitting the ball. The HS, trajectory, and velocity drop can be determined by displaying, or by performing numerical processing on, the data relating to the instantaneous position and velocity of the iron head.

The data, which are numerically objective, and feedback from the testers together can be used to set a standard for assessing whether or not the "release" is good or bad. From this, we can see that tester B prefers a 10° bounce angle, whereas the tester C prefers a 5° bounce angle. When the bounce angle was 5°, it can be seen that all of the testers give an assessment of suitably good and the velocity drop was small. In the case of a bounce angle of 0°, the feedback from the testers was negative and there was a large velocity drop after impact. The 10° bounce angle was unpopular with the testers that had a slow HS, whereas it received favorably by the tester that had a fast HS.

What is claimed is:

1. A method for designing an iron sole shape, comprising the steps of:

setting different parameter values relating to a sole shape while keeping parameters other than those of the sole shape constant, wherein the sole shape comprises at least one of bounce. scoop, round and flat;

preparing an iron club having the parameter values that have been set;

a tester using the iron club that has been prepared to hit a ball, measuring a path of the club head using a camera while the ball is hit;

obtaining data on the drop in the velocity of the club head before hitting the ball and after hitting the ball and on incident angle of the club head with respect to the ground in the measuring step; and changing the parameter values that have been set based on the data that have been obtained.

2. The method according to claim 1, further comprising the step of a computation means statically processing the data to further determine whether or not the parameter values that have been set are favorable.

3. The method according to claim 1, further comprising the steps of:

measuring an initial velocity and a direction of the ball hit by the tester; and determining whether or not the parameter values relating to the sole shape are favorable based on a variation in the measured initial velocity or the direction, or both.

4. An iron club that has been designed by the method set forth in claim 1.

5. An iron club set that has been designed by the method set forth in claim 1.

6. The method according to claim 1, wherein the different parameter values relating to sole shape comprise different bounce angle values.

7. An iron sole design system, comprising:

a device for inputting different parameter values relating to a sole shape, wherein the sole shape comprises at least one of bounce, scoop, round and flat;

a high-speed camera for capturing images of a tester hitting a ball with an iron club in order to acquire a path traveled by an iron head;

head computation means for performing image processing on the path that has been captured so as to obtain data on the drop in the velocity of the club head before hitting the ball and after hitting the ball and on incident angle of the club head with respect to the ground; and display means for displaying a set of the input different parameter values and the different data on drop in velocity and the incident angle that have been obtained using the iron clubs having the input different parameter values.

8. The system according to claim 7, further comprising:

a first determination means for determining, based on a predetermined determination standard, whether or not the parameter values relating to the sole shape of the iron club are favorable based on at least the data on the drop in velocity, and displaying the result of the determination.

9. The system according to claim 7, further comprising:

ball computation means that employs image processing to obtain data on an initial velocity and a direction of the ball that has been hit; and a second determination means for determining whether or not the parameter values relating to the sole shape are favorable based on a variation in the initial velocity or the direction, or both, of the ball.

10. The system according to claim 7, wherein the different parameter values relating to sole shape comprise different bounce angle values.

* * * * *